US011371256B1

(12) United States Patent
Lyons

(10) Patent No.: US 11,371,256 B1
(45) Date of Patent: Jun. 28, 2022

(54) FENCE BRACING APPARATUS AND METHOD OF USING THE SAME

(71) Applicant: Raymond Lyons, Hartsel, CO (US)

(72) Inventor: Raymond Lyons, Hartsel, CO (US)

( * ) Notice: Subject to any disclaimer, the term of this patent is extended or adjusted under 35 U.S.C. 154(b) by 720 days.

(21) Appl. No.: 15/889,097

(22) Filed: Feb. 5, 2018

Related U.S. Application Data

(60) Provisional application No. 62/454,385, filed on Feb. 3, 2017.

(51) Int. Cl.
*E04H 17/14* (2006.01)

(52) U.S. Cl.
CPC ..... *E04H 17/1417* (2013.01); *E04H 17/1447* (2021.01); *E04H 17/1452* (2021.01)

(58) Field of Classification Search
CPC ..... E04H 17/06; E04H 17/08; E04H 17/20; E04H 17/22; E04H 17/1421; E04H 2017/1452; E04H 2017/1447
See application file for complete search history.

(56) References Cited

U.S. PATENT DOCUMENTS 991,913 A 5/1911 Von Engelin
4,889,322 A 12/1989 Wagner
4,936,550 A 6/1990 Wickham et al.
5,061,109 A 10/1991 Miller
5,139,235 A 8/1992 Kilmer
5,215,290 A * 6/1993 Khalessi ..... E04H 17/1421 256/19
5,518,333 A * 5/1996 Cienkus, Jr. ..... E04H 17/06 256/59
5,593,143 A 1/1997 Ferrain
5,961,242 A * 10/1999 Leone ..... F16B 2/08 403/234
6,443,433 B1 9/2002 Auldridge
6,705,598 B2 3/2004 Collins
7,070,136 B1 7/2006 Bailey
7,458,744 B2 * 12/2008 Hall ..... F16B 7/0486 403/187
7,726,037 B1 * 6/2010 Jordan ..... E04H 17/20 33/613
8,480,061 B2 * 7/2013 Graves ..... E04H 17/20 256/65.03
9,151,074 B2 * 10/2015 Walters ..... E04H 17/1421

OTHER PUBLICATIONS

New Farm, "Speed Brace Fence Brace Kit," Retreievd from URL https://www.valleyvet.com/, May 23, 2016, 16 pages.
Hoover Fence Co., "T-Post Wood to Steel Adapter," Retrieved from URL http://www.hooverfence.com/woodfence/twpa.htm, May 23, 2016, 1 page.
Wedge-Loc, "Welcome to Wedge-Loc®", Retreived from URL http://www.wedgeloc.com/index.html, May 23, 2016, 1 page.

* cited by examiner

*Primary Examiner* — Jonathan P Masinick
(74) *Attorney, Agent, or Firm* — Messner Reeves LLP; Scott J. Hawranek

(57) ABSTRACT

Bracing devices, bracing system and method of using the same is disclosed which is particularly suitable for providing line and end corner bracing for conventional corner post system.

20 Claims, 25 Drawing Sheets

FENCE BRACING APPARATUS AND METHOD OF USING THE SAME

The present application claims the benefit of U.S. Provisional Patent Application No. 62/454,385 filed Feb. 3, 2017, this provisional patent application is hereby fully incorporated herein by reference.

BACKGROUND OF THE INVENTION

Field of the Invention

The present invention generally relates to a fence bracing apparatus and method of using the same, and more particularly to a method and system for a fencing system.

SUMMARY OF THE INVENTION

Accordingly, the invention is directed to a fence bracing apparatus and method of using the same that substantially obviates one or more of the problems due to limitations and disadvantages of the related art.

An advantage of the invention is to provide a simple and rapid fencing system that is configured to permit anyone to make a fence that is very strong and will last years and years.

Yet another advantage of the invention is to provide a fencing system that can be installed with no special tools in a cost effective and time saving manner over the related art.

Still yet another advantage of the invention is to provide a fencing system that can be installed with adjustable diagonal braces configured to allow installation on non-level ground with various grades.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a fence post bracing member for use in a section of fence includes an elongated tubular portion having a first end having a first bracket, a second end having a second bracket and a lumen extending from the first end to the second end. The first bracket is arranged at a first angle relative to a center-line of the elongated tubular bracket and the second bracket is arranged at a second angle relative to a center-line of the elongated tubular member. The first angle is different than the second angle. The fence post member also includes an elongated member having a first end having a third bracket and the second end having no bracket. The second end of the elongated member is configured to fit within a portion of the lumen. The third bracket is arranged at a third angle relative to a center-line of the elongated member. The first angle and the third angle are substantially identical to each other.

In another aspect of the present invention, a fence post bracing member for use in a section of fence includes an elongated member having a first end having a first bracket and the second end having a second bracket. The first bracket is arranged at a first angle relative to a center-line of the elongated member. The second bracket is arranged at a second angle relative to a center-line of the elongated member. The first bracket is attached to the first end at a first offset, and the second bracket is attached to the second end at a second offset.

In yet another aspect of the present invention, a method of installing a corner fence system includes providing a first corner fence post. Anchoring the first corner fence post to a location in the ground and measuring a distance from the first corner fence post with a non-adjustable horizontal brace, wherein the non-adjustable horizontal brace comprises an elongated member having a first end having a first bracket and a second end having a second bracket, wherein the first bracket is arranged at a first angle relative to a center-line of the elongated member, wherein the second bracket is arranged at a second angle relative to a center-line of the elongated member, wherein the first bracket is attached to the first end at a first offset, and wherein the second bracket is attached to the second end at a second offset. Next, providing a second corner fence post to a location measured and anchoring the second corner fence post to a distance in the ground. The method further includes providing an adjustable angle brace comprising an elongated tubular portion having a first end having a first bracket, a second end having a second bracket and a lumen extending from the first end to the second end, wherein the first bracket is arranged at a first angle relative to a center-line of the elongated tubular bracket and the second bracket is arranged at a second angle relative to a center-line of the elongated a tubular member, wherein the first angle is different than the second angle and an elongated member arranged within a portion of the elongated tubular such that a predetermined distance protrudes from the elongated tubular portion, the having a first end having a third bracket and the second end having no bracket, wherein the third bracket is arranged at a third angle relative to a center-line of the elongated member, wherein the first angle and the third angle are substantially identical to each other. The method also includes simultaneously attaching the non-adjustable horizontal brace and the adjustable angle brace to the first corner post and attaching the non-adjustable horizontal brace and the adjustable angle brace to the second corner post.

This Summary section is neither intended to be, nor should be, construed as being representative of the full extent and scope of the present disclosure. Additional benefits, features and embodiments of the present disclosure are set forth in the attached figures and in the description herein below, and as described by the claims. Accordingly, it should be understood that this Summary section may not contain all of the aspects and embodiments claimed herein.

Additionally, the disclosure herein is not meant to be limiting or restrictive in any manner. Moreover, the present disclosure is intended to provide an understanding to those of ordinary skill in the art of one or more representative embodiments supporting the claims. Thus, it is important that the claims be regarded as having a scope including constructions of various features of the present disclosure insofar as they do not depart from the scope of the methods and apparatuses consistent with the present disclosure (including the originally filed claims). Moreover, the present disclosure is intended to encompass and include obvious improvements and modifications of the present disclosure.

The preceding is a simplified summary of the disclosure to provide an understanding of some aspects of the disclosure. This summary is neither an extensive nor exhaustive overview of the disclosure and its various aspects, embodiments, and/or configurations. It is intended neither to identify key or critical elements of the disclosure nor to delineate the scope of the disclosure but to present selected concepts of the disclosure in a simplified form as an introduction to the more detailed description presented below. As will be appreciated, other aspects, embodiments, and/or configurations of the disclosure are possible, utilizing, alone or in combination, one or more of the features set forth above or described in detail below.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE ILLUSTRATED EMBODIMENTS

Figure 1A:
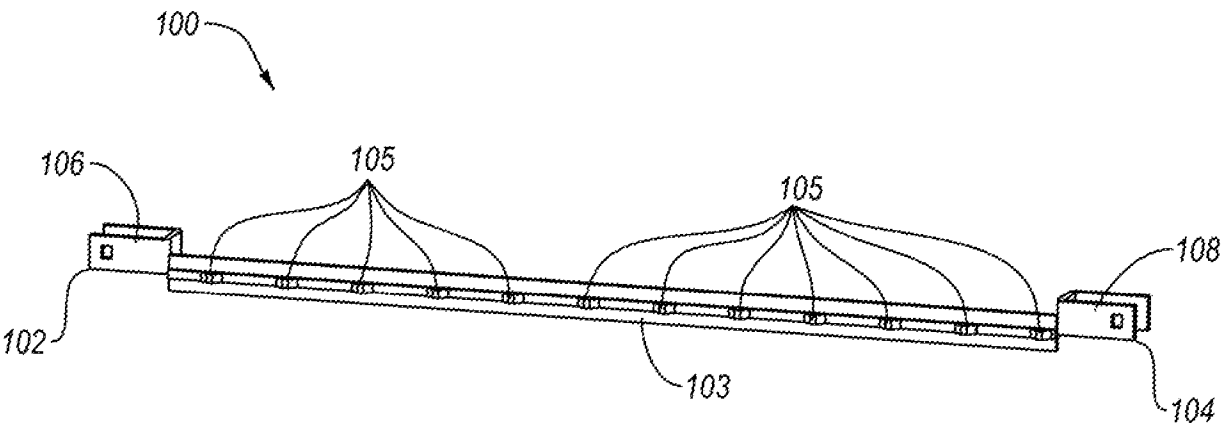
FIG. 1A illustrates an exemplary side view of a horizontal brace according to an embodiment of the invention.

As used herein, "comprising," "including," "containing," "is," "are," and "characterized by," are grammatical equivalents thereof are inclusive or open-ended terms that do not exclude additional unrecited elements or method steps unless explicitly stated otherwise.

It is to be understood that both the foregoing general description and the following detailed description are exemplary and explanatory and are intended to provide further explanation of the invention as claimed.

The phrases "at least one," "one or more," and "and/or" are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" means A alone, B alone, C alone, A and B together, A and C together, B and C together, or A, B and C together.

The term "a" or "an" entity refers to one or more of that entity. As such, the terms "a" (or "an"), "one or more" and "at least one" can be used interchangeably herein. It is also to be noted that the terms "comprising," "including," and "having" can be used interchangeably.

In order to more fully appreciate the present disclosure and to provide additional related features, the following references are incorporated therein by reference in their entirety:

(1) U.S. Pat. No. 4,889,322 by Wagner which discloses a bracing system particularly suitable for providing line and end corner bracing for "T-post" fence construction. The bracing system comprises slidable collars which are positioned over the posts and located vertically between the lugs at a desired location. A wedging arrangement is used to secure the collar between adjacent lugs on the posts, and the collar has provisions for accepting accessories to permit a rigid cross-brace, typically also another "T-post", to be inserted therebetween for providing rigid cross-bracing between adjacent "T-posts" of the fence. Accessories also are disclosed to adapt the posts for uses other than fences.

(2) U.S. Pat. No. 4,936,550 by Wickham, et al. which discloses a connector plate for use with T-posts permitting great versatility in bracing, extending, guying and otherwise enhancing the utility and strength of T-posts. The connector comprises a rigid plate having a minor portion and a major portion connected at an angle which may be oriented variably on a T-post by virtue of unique aperture arrangements and have other such plates and T-posts quickly connected thereto.

(3) U.S. Pat. No. 5,061,109 by Miller which discloses improved fence bracing members, and a method of using the bracing members on metal T-posts of a fence. The bracing members include two substantially identical elongated first members each made of corrosion resistant tubing, and further having somewhat flexible U-shaped or hooked oppositely disposed ends. Each hooked end of the first bracing members is apertured to receive a single bolt to allow the compressing of the hook onto a T-post. The first bracing members are structured for spanning horizontally between, and attaching with the hooked portions placed around a T-post. One first bracing member is placed adjacent the ground, and one first bracing member is placed adjacent the upper ends of the T-posts. An elongated straight bracing member having bolt receiving apertures at two oppositely disposed terminal ends thereof, is used for a diagonal brace between the two vertical T-posts, extending at an angle from an attachment point to the upper bracing member adjacent one T-post, downward at an angle to an attachment point to the lower bracing member adjacent the other T-post. Nuts and bolts are used to attach the bracing members on T-posts installed in the ground. The bracing members having the hooked ends have been structured in a manner which allows the brace to be used as a measuring gage for quickly determining the proper distance two T-posts should be set apart prior to bracing.

(4) U.S. Pat. No. 5,139,235 by Kilmer which discloses, an improved fence post system that permits insertion of a fence post into the earth and attachment of a support brace without the use of tools. A fence post unit includes an augered base, a removable extension piece and a bracket. The bracket may be used alternately to support a handlepiece which is rotated in order to auger the post into the ground, and to couple a support brace. Several units may be coupled to form a corner fence post. The base unit is equipped with a stabilizer device for lateral support.

(5) U.S. Pat. No. 5,593,143 by Ferrarin which discloses a universal post connector for interconnecting fence posts and braces either of which may be a pipe post or tee post at any horizontal or vertical angle and at any position along the length of each. The universal connector is also adaptable to tee posts and pipe posts of all standard cross-sectional sizes. The preferred embodiment includes a pair of sleeves and a pair of collars to interconnect two tee posts. At least one sleeve is slipped onto each tee post and fastened thereto at any position along the length of the tee post using a fastening device. A collar encircles each sleeve and is clamped at any position along the length of the sleeve. A coupler pivotally interconnects the collars and locks the collars at variable angles with respect to each other. In the case where a pipe post is used in place of a tee post, the collar can be directly clamped to the pipe post without using a sleeve.

(6) U.S. Pat. No. 6,443,433 by Auldridge which discloses a fence system using extruded bars of T-shaped cross-section to form posts and rails, and a plurality of connectors to connect the T-bars. The connectors have vertical and horizontal V-channels within which the T-bars are secured. Each V-channel has a pair of sides which meet at a vertex, and an open end. A plurality of clamping mechanisms each include a cross plate which extends across the open end of the V-channel to hold the T-bar therein, and a pair of J-bolts which secure to both the V-channel sides and the cross plate. An inverted U-channel extends between the cross plate and the T-bar to directly engage the T-bar and hold it tightly against the vertex of the V-channel. The T-bar has a plurality of spaced protuberances thereon. A transverse pin extends across the U-channel so that when the clamping mechanism is engaged with the T-bar, interference between the transverse pin and the protuberances prevent the T-bar from slipping longitudinally within the V-channels. Both upper and lower connectors may be provided at each post to provide a dual horizontal rail fence.

(7) U.S. Pat. No. 6,705,598 by Collins which discloses a fence post connector including a securement section for securing the post connector to a fence post and at least one receiving section for receiving an item to be joined. The item to be joined may be the end of a stabilizing fence post, a gate hinge, etc. For attachment to a T-post, a closure member captures the T-post between a pair of spaced arms extending from the receiving section and travel of the post connector along the T-post is limited by adjacent lugs extending from the T-post. These lugs may cooperate with the closure member, an arm, or the portion of the connector spacing the arms, to limit sliding. For attachment to a wood post, at least one arm abuts the post with an opening through which a fastener, such as a nail or screw, extends into the post. The post connector is generally used to connect fence posts in reinforcing configuration and loosely connects the various fence posts. The loose connection allows easy assembly of the various posts and tightening of one or more wires between posts tightens the posts and post connectors into a substantially rigid section of fence.

(8) U.S. Pat. No. 7,070,136 by Bailey which discloses a fence assembly including a first fence post extending upwardly from the ground; a first tubular member having a first upper end and a first lower end, the first tubular member being received over but not connected to the first fence post such that the first lower end rests upon the ground; a first lug laterally extending from the first tubular member; a second fence post extending upwardly from the ground; a second tubular member having a second upper end and a second lower end, the second tubular member being received over but not connected to the second fence post such that the second lower end rests upon the ground; a second lug laterally extending from the second tubular member; a brace having opposing ends; a first connection means for removably connecting one end of the brace to the first lug; and a second connection means for removably connecting the other end of the brace to the second lug. According to another aspect of the invention, a combination of a tubular member and pairs of fixed and rotatable sleeves with lugs extending therefrom can be received over a fence post for use in numerous possible fencing configurations.

Reference will now be made in detail to an embodiment of the present invention, example of which is illustrated in the accompanying drawings.

Figure 1B:
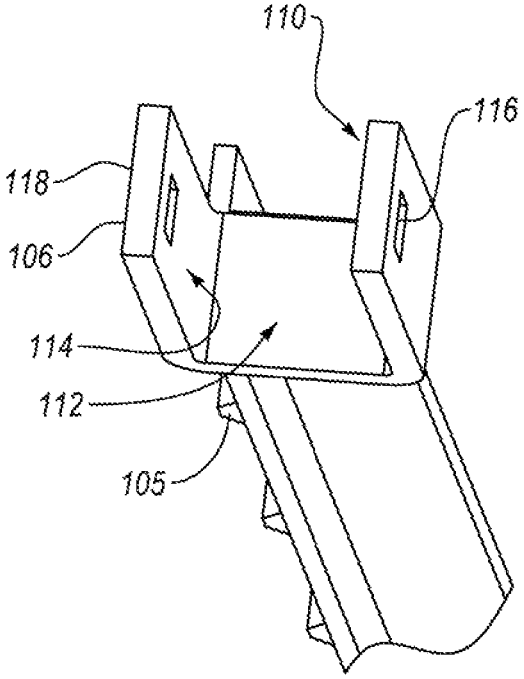
FIG. 1B illustrates an exemplary end view of the horizontal brace of FIG. 1A.
Figure 1C:
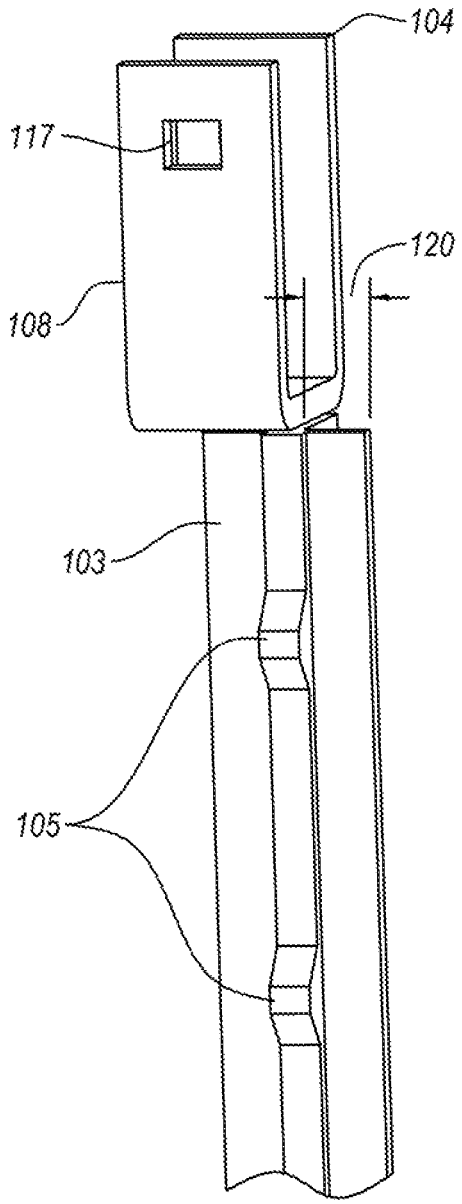
FIG. 1C illustrates an exemplary perspective end view of the horizontal brace of FIG. 1A.
Figure 1D:
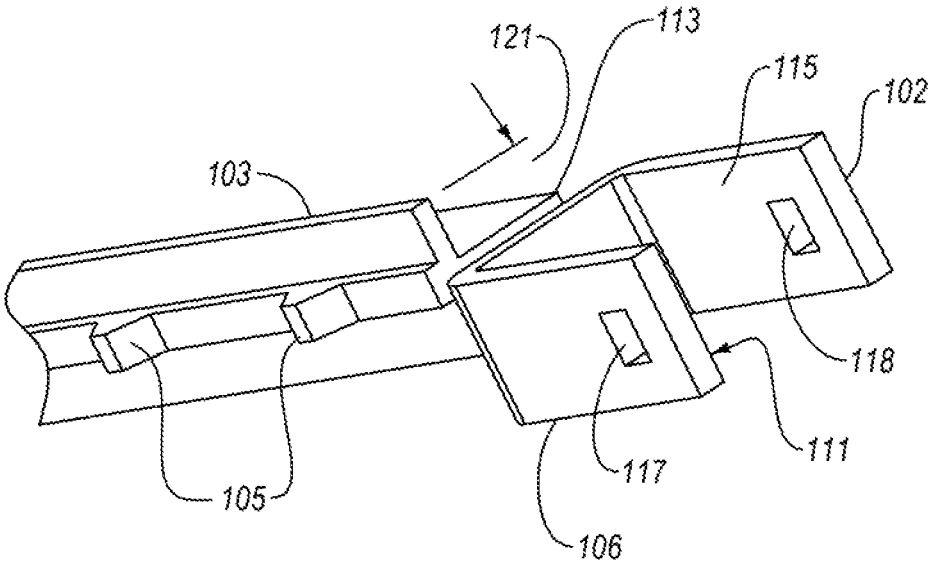
FIG. 1D illustrates an exemplary perspective second end view of the horizontal brace of FIG. 1A.
Figure 1E:
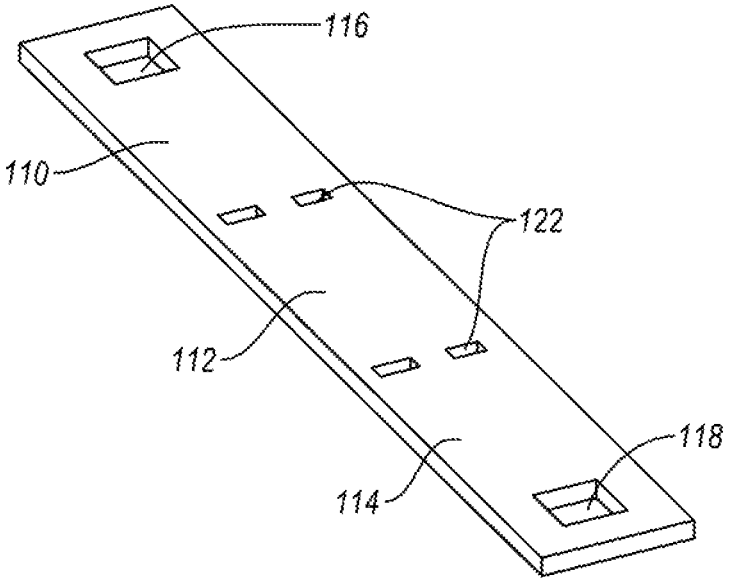
FIG. 1E illustrates an exemplary top view of a bracket according to an embodiment of the invention.

FIG. 1A illustrates an exemplary side view of a horizontal brace according to an embodiment of the invention. FIG. 1B illustrates an exemplary end view of the horizontal brace of FIG. 1A. FIG. 1C illustrates an exemplary perspective end view of the horizontal brace of FIG. 1A. FIG. 1D illustrates an exemplary perspective second end view of the horizontal brace of FIG. 1A. FIG. 1E illustrates an exemplary top view of a bracket according to an embodiment of the invention.

Referring to FIGS. 1A-1E, a horizontal brace 100 for a fencing system includes a first end 102, a second end 104, and a middle section 103 extending from the first end 102 to the second end 104. A bracket 106 is attached in an offset configuration to the first end 102 in a co-linear orientation (in the same orientation as a centerline) of the middle section 103. A bracket 108 is attached in an offset configuration to the second end 104. The bracket 106 includes first section 110, a middle section 112 and a second section 114. The first section 110 and middle section 112 are arranged at an angle of about ninety degrees between the two sections. The second section 114 and middle section 112 are arranged at an angle of about ninety degrees between the two sections. A bracket 108 is attached in an offset configuration to the second end 104. The bracket 108 includes first section 111, a middle section 113 and a second section 115. The first section 111 and middle section 113 are arranged at an angle of about ninety degrees between the two sections. The second section 115 and middle section 111 are arranged at an angle of about ninety degrees between the two sections. Bracket 106 includes a first hole 116 and a second hole 118. Bracket 108 also includes a first hole 117 and a second hole 119. The bracket shown in FIG. 1E can be used for the first bracket 106 and second bracket 108. In a preferred embodiment, each of the brackets has length in a range from about 2 inches to about 8 inches or greater and a thickness in a range from about 0.06 inches to about 0.25 inches or greater.

In one embodiment, the middle section 103 can be a conventional T-post or Y-post made of metal, e.g., steel, alloy, thermoplastic, rail steel and combinations of the same. When using the conventional T-Post or Y-post, the end portions are removed to make ends a ninety-degree angle configured to receive a brace. The horizontal brace 100 includes studs or nubs or protrusions 105 spaced along the length of the brace. These protrusions 105 are configured to allow the brace to couple between the protrusions 105. In a preferred embodiment, the spacing between the protrusions is uniform throughout the length of the middle section 103. The spacing could be in the range from about 0.10 inches to about 2 inches or greater between the protrusions 105. Optionally and/or alternatively, the spacing may be non-uniform.

The first bracket 106 and the second bracket 108 are made from material including one or more of metal, steel, iron, thermoplastic, alloy and combinations of the same. Referring to FIG. 1E, the bracket includes a first section 110, middle section 112, and second section 114. Each of the brackets 106 and 108 includes one or more perforations or holes 122 configured to allow the bracket to bend to an angle in the range from about 0 degrees to about 180 degrees. In a preferred embodiment, the bracket is bent to an angle of about 90 degrees between the first section 110 and middle section 112 and the bracket is bent to an angle of about 90 degrees between the middle section 112 and the second section 114. The perforations 122 are optional and allow the brackets to be more easily bent without breaking or distorting. Optionally and/or alternatively, a crease may be formed along an imaginary line of the performations and/or the material may be thinned or removed along the imaginary line of performations. Optionally and/or alternatively, each of the sides may be notched (along an imagenary line of the performations) to remove a notch of material in range from about 0.06 inches to about 0.25 inches or greater. Also, any combination of notches, performations, creasing and/or removed or thinned material may be utilized. The performations, notches, creases, and/or removed material create a living hinge that allows the bracket to be moved to a desired angle as described herein. For example, the perforations may be in range from about 0.001 inch to 0.025 inch or greater. In a preferred embodiment, the perforations have an oblong geometry are about ⅛ inch in diameter. The first section 110 also includes a hole 116 configured and sized to receive a square portion of a bolt (not shown) to allow a portion of the bolt to reside in the hole. The second section 114 also includes a hole 118 configured and sized to receive a square portion of a bolt (not shown).

Referring to FIG. 1C, the bracket 106 is welded to an end portion of the middle section 103 of the post. The bracket is positioned or attached in an offset 120 configuration, the offset 120 being in a range from about 5 percent to about 50 percent or greater relative to the welded surface, e.g., the percentage is the percentage of the total width of the end portion. Other conventional attachment methods may be utilized to attach the brackets 106 and 108 to end portions of the midsegment 110. Bracket 108 also includes an offset 121 at the same percentage as the offset 120.

Figure 2A:
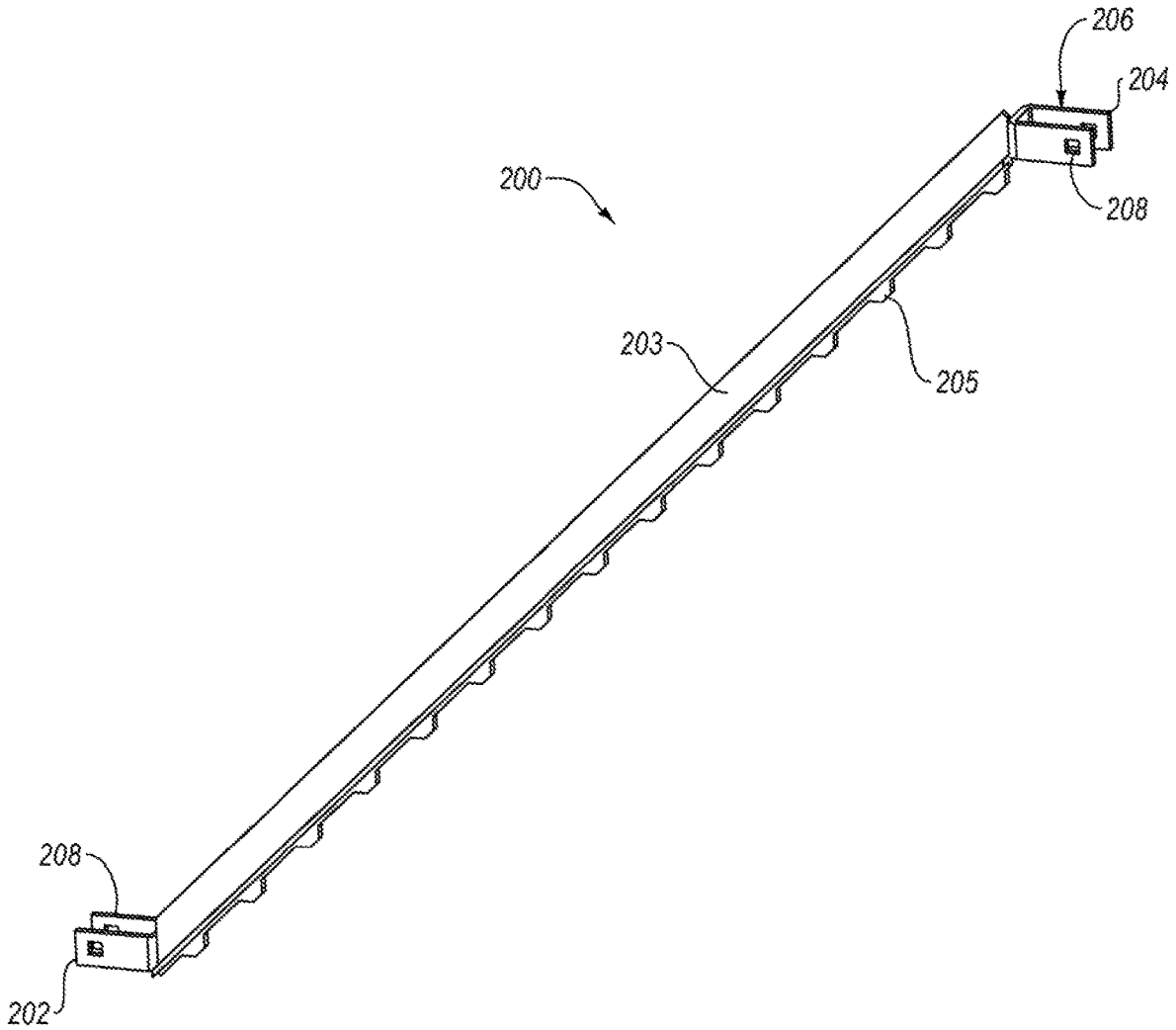
FIG. 2A illustrates an exemplary side view of a non-adjustable angle brace according to an embodiment of the invention.
Figure 2B:
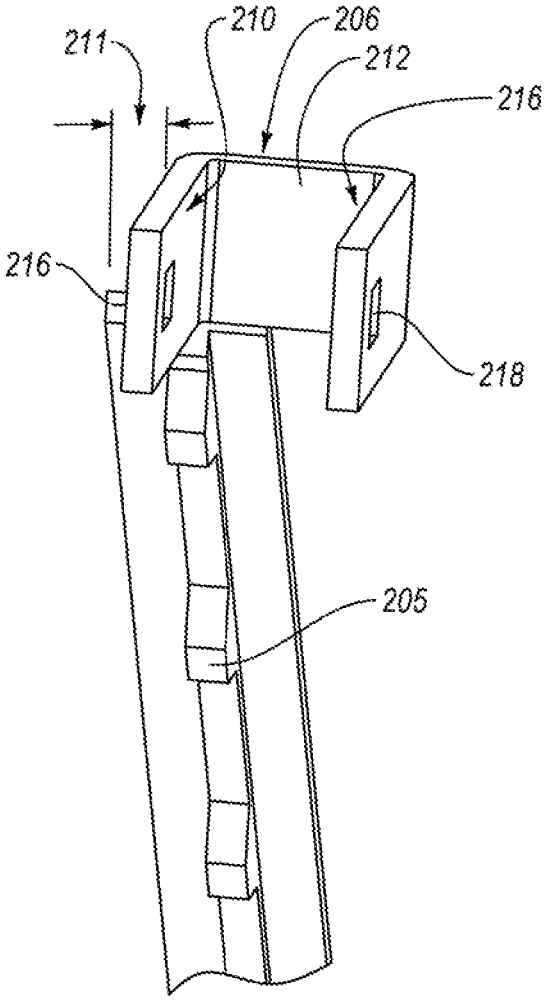
FIG. 2B illustrates an exemplary end view of the non-adjustable angle brace of FIG. 2A.
Figure 2C:
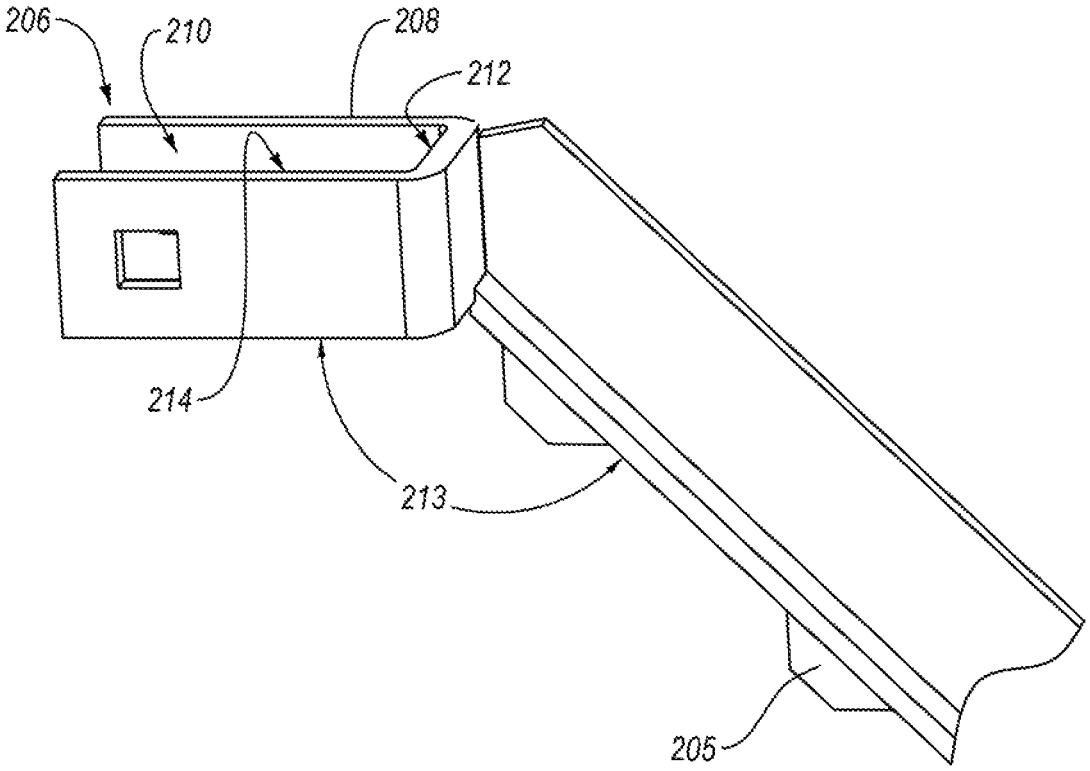
FIG. 2C illustrates an exemplary side end view of the non-adjustable angle brace of FIG. 2A.
Figure 2D:
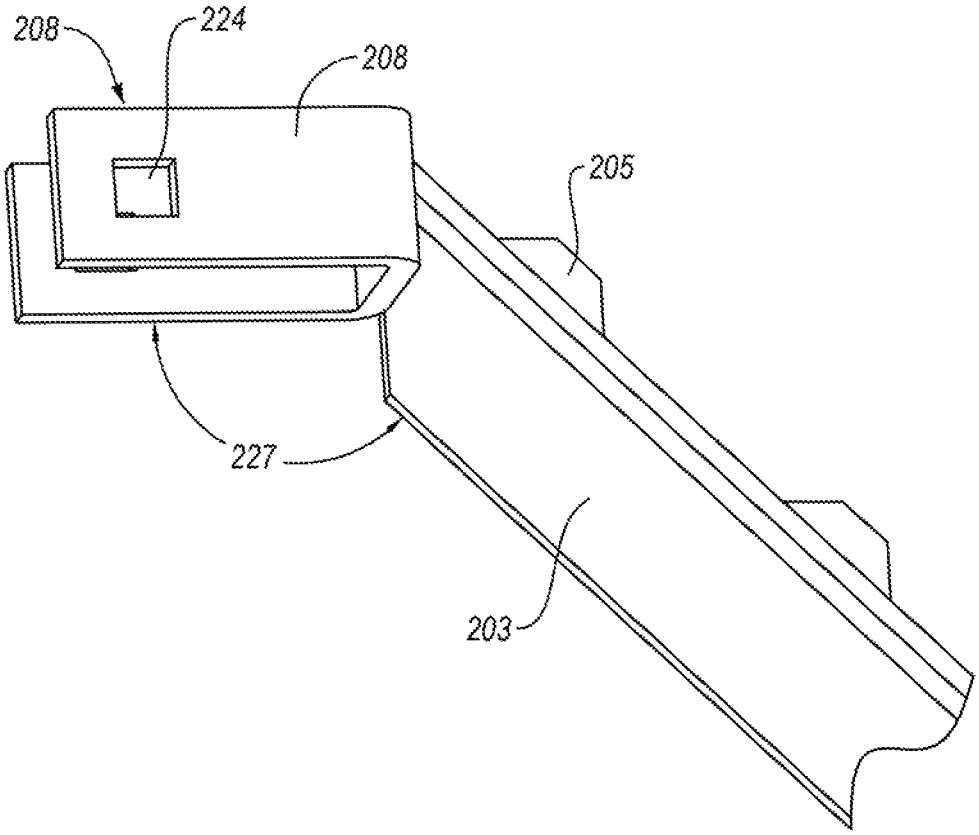
FIG. 2D illustrates an exemplary side end view of the non-adjustable angle brace of FIG. 2A.
Figure 2E:
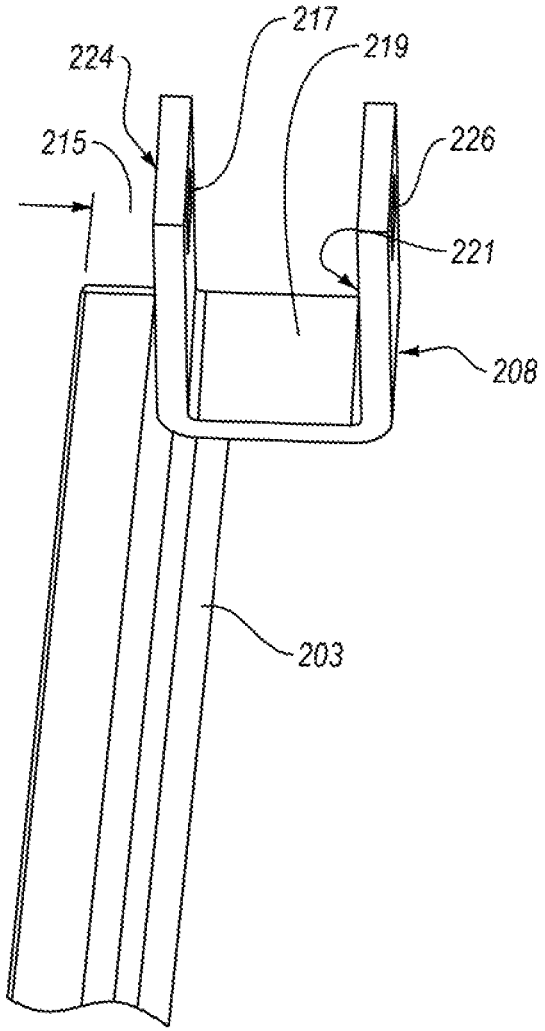
FIG. 2E illustrates an exemplary perspective end view of the non-adjustable angle brace of FIG. 2A.

FIG. 2A illustrates an exemplary side view of a non-adjustable angle brace according to an embodiment of the invention. FIG. 2B illustrates an exemplary end view of the non-adjustable angle brace of FIG. 2A. FIG. 2C illustrates an exemplary side end view of the non-adjustable angle brace of FIG. 2A. FIG. 2D illustrates an exemplary side end view of the non-adjustable angle brace of FIG. 2A. FIG. 2D illustrates an exemplary perspective end view of the non-adjustable angle brace of FIG. 2A.

Referring to FIGS. 2A-2C, the non-adjustable brace 200 for a fencing system includes a first end 202, a second end 204, and a middle section 203 extending from the first end 202 to the second end 204. A bracket 206 is attached in an offset 211 to an end portion of the first end 202 at angle 213 relative to a centerline of the middle section 203. The bracket 206 is attached, e.g., welded, at an offset 211 and angled 213 configuration to the second end 204. The bracket 206 includes first section 210, a middle section 212 and a second section 214. The first section 210 and middle section 212 are arranged at an angle of about ninety degrees between the two sections. The second section 214 and middle section 212 are arranged at an angle of about ninety degrees between the two sections.

The second end 204 includes a bracket 208 attached in an offset 215 and angle 213. The bracket 208 includes first section 217, a middle section 219, and a third section 221. The first section 217 and middle section 219 are arranged at an angle of about ninety degrees between the two sections. The second section 221 and middle section 219 are arranged at an angle of about ninety degrees between the two sections. Bracket 206 includes a first hole 216 and a second hole 218. Bracket 208 also includes a first hole 224 and a second hole 226. The bracket shown in FIG. 1E can be used for the first bracket 206 and second bracket 208. In a preferred embodiment, each of the brackets has length in a range from about 2 inches to about 8 inches or greater and a thickness in a range from about 0.06 inches to about 0.25 inches or greater.

In one embodiment, the middle section 203 can be a conventional T-post or Y-post made of metal, e.g., steel, alloy, thermoplastic, rail steel and combinations of the same. When using the conventional T-Post or Y-post, the end portions are removed to make ends a ninety-degree angle configured to receive a brace. The middle section 203 includes studs or nubs or protrusions 205 spaced along the length of the brace. These protrusions 205 are configured to allow the brace to couple between the protrusions 205. In a preferred embodiment, the spacing between the protrusions is uniform throughout the length of the middle section 203. The spacing could be in the range from about 0.10 inches to about 2 inches or greater between the protrusions 205. The height of the protrusions 205 can be in a range from about 0.05 inches to about 0.75 inches or greater.

The non-adjustable brace 200 is made from material including one or more of metal, steel, iron, thermoplastic, alloy and combinations of the same. In a preferred embodiment, the bracket 206, 208 is shown in FIG. 1E and explained herein.

Referring to FIG. 2C, the bracket 206 is welded to an end portion of the middle section 203 of the non-adjustable brace 200. The bracket 206 is positioned or attached in an offset 211 in a range from about 5 percent to about 50 percent or greater. The percentage is the percentage of the total width of the end portion. Other conventional attachment methods may be utilized. The bracket 206 is positioned or attached at an angle 213 in a range from about 5 degrees to about 60 degrees. In a preferred embodiment, the angle 213 is about 45 degrees. The bracket 208 is positioned or attached, e.g., welded, at an offset 215 in a range from about 5 percent to about 50 percent or greater. The percentage is the percentage of the total width of the end portion. Other conventional attachment methods may be utilized. The bracket is positioned or attached at an angle 227 in a range from about 5 degrees to about 60 degrees. In a preferred embodiment, the angle 227 is about 45 degrees. In a preferred embodiment, the angle 227 and angle 213 are substantially identical.

Figure 3A:
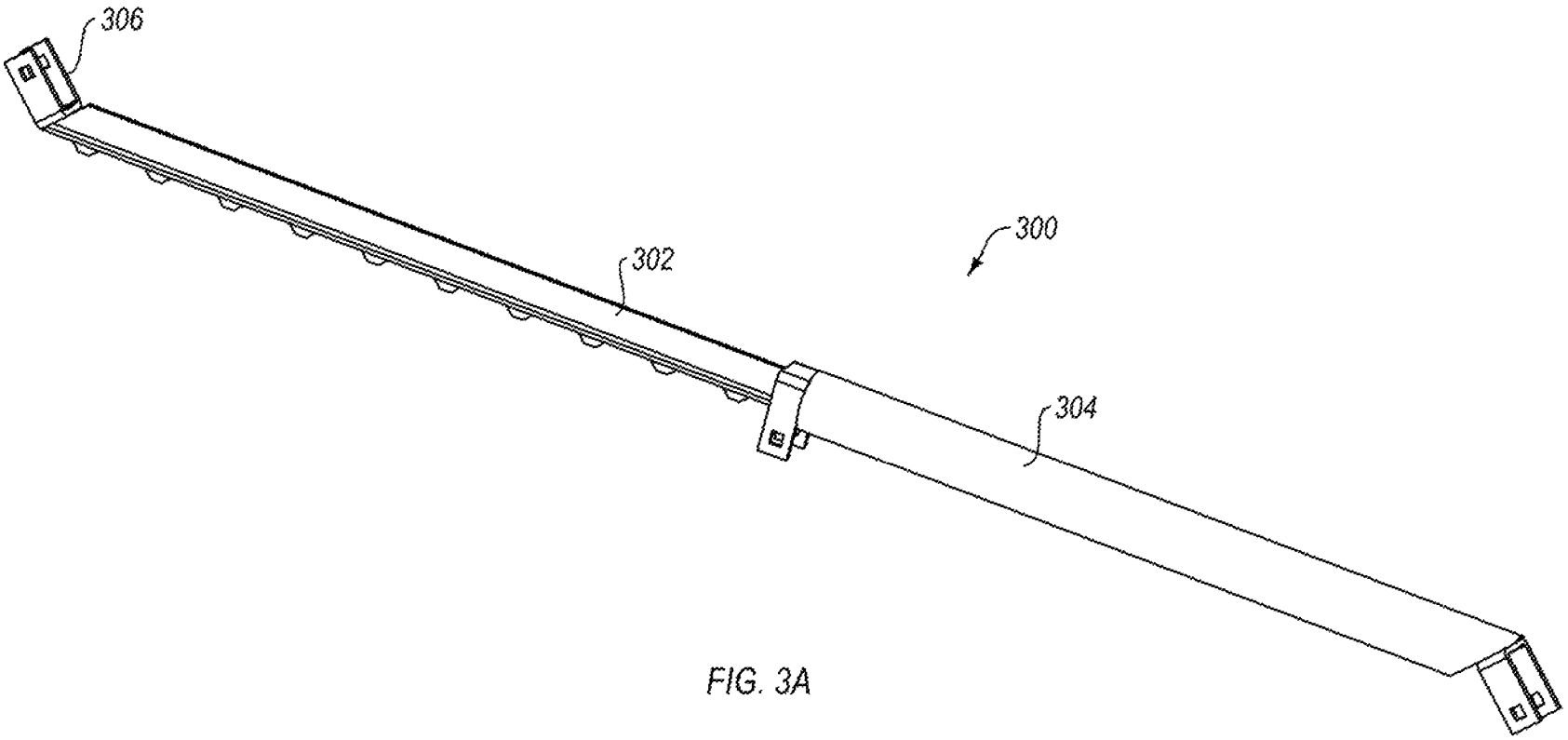
FIG. 3A illustrates an exemplary side view of an adjustable angle brace according to an embodiment of the invention.
Figure 3B:
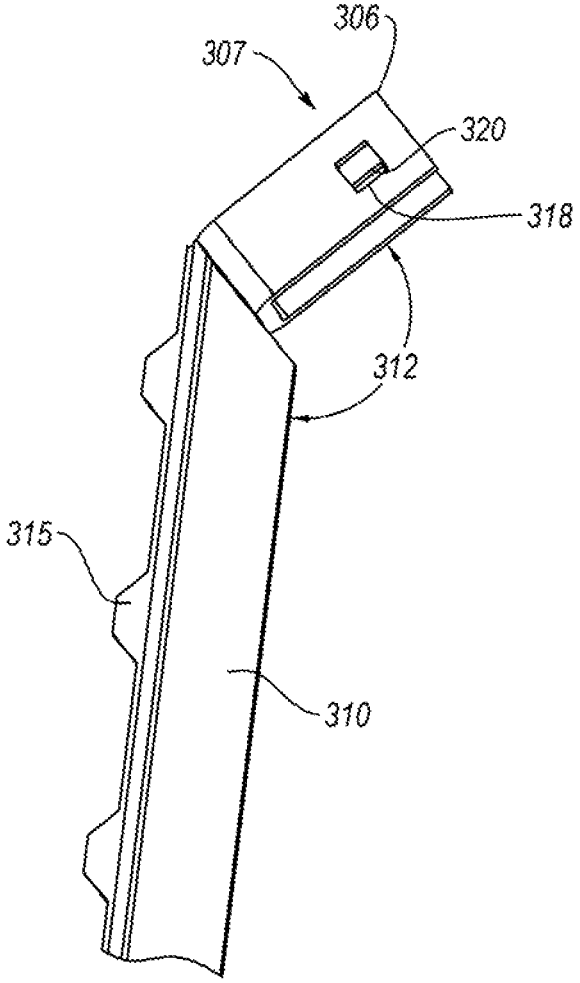
FIG. 3B illustrates an exemplary side end view of an adjustable angle brace of FIG. 3A.
Figure 3C:
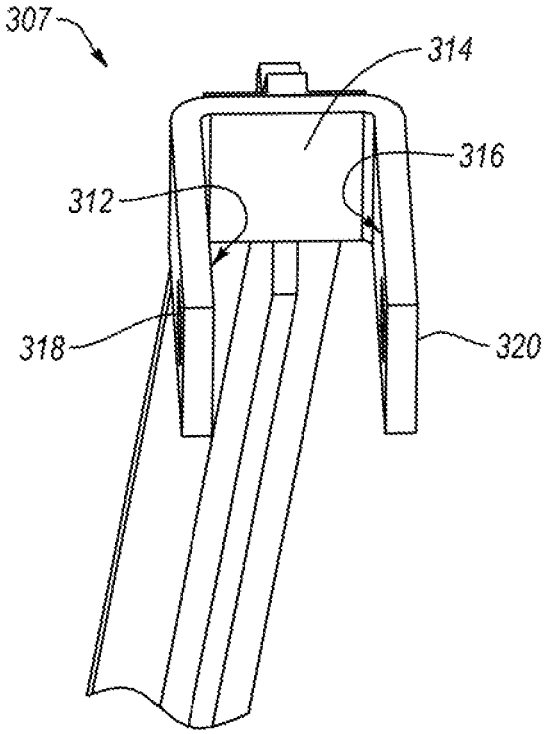
FIG. 3C illustrates an exemplary end view of an adjustable angle brace of FIG. 3A.
Figure 3D:
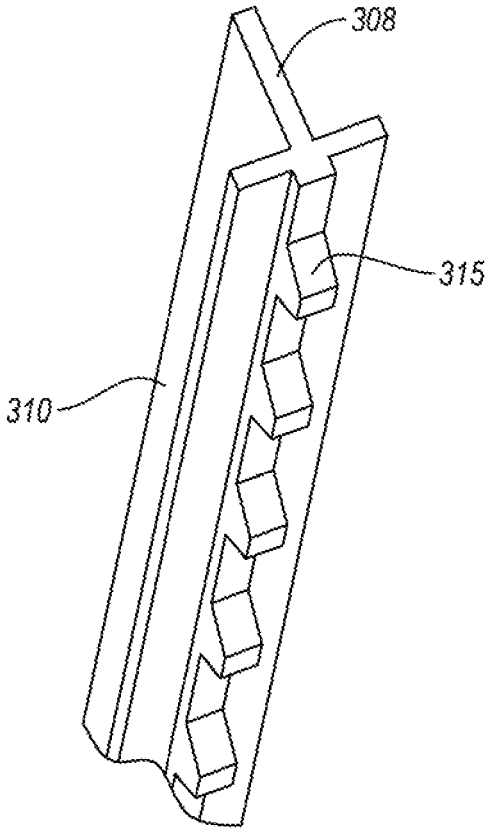
FIG. 3D illustrates an exemplary end view of an adjustable angle brace of FIG. 3A.
Figure 3E:
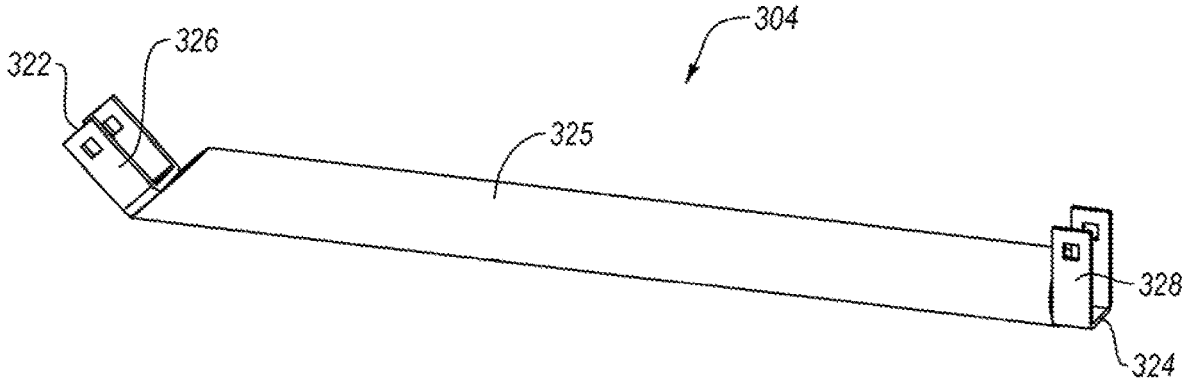
FIG. 3E illustrates an exemplary side view of an adjustable angle brace sleeve of FIG. 3A.
Figure 3F:
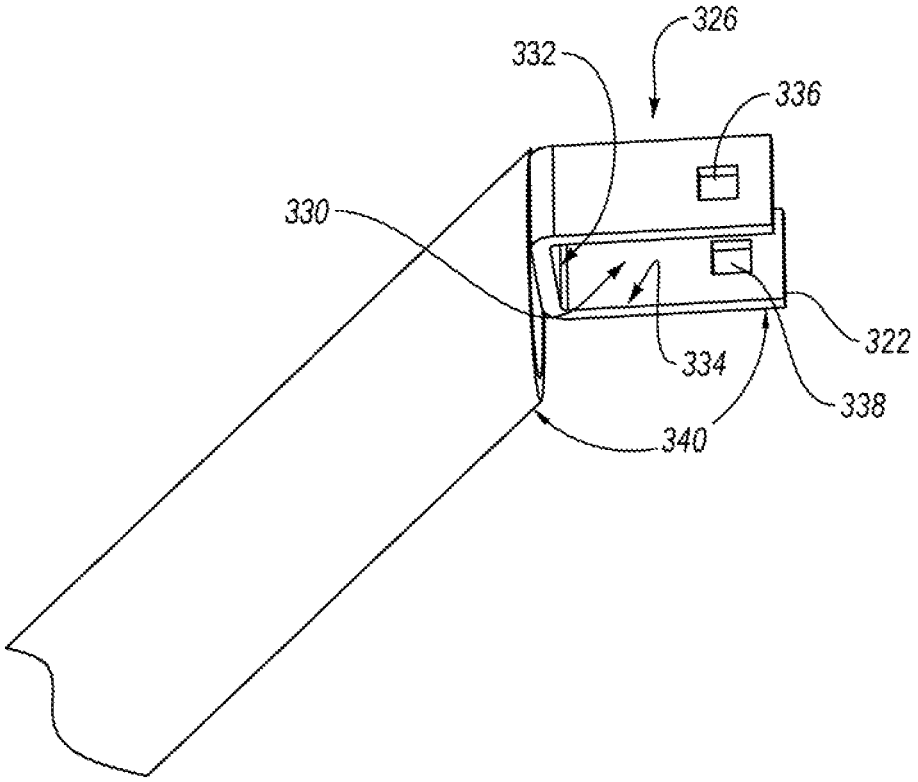
FIG. 3F illustrates an exemplary end view of an adjustable angle brace sleeve of FIG. 3E.
Figure 3G:
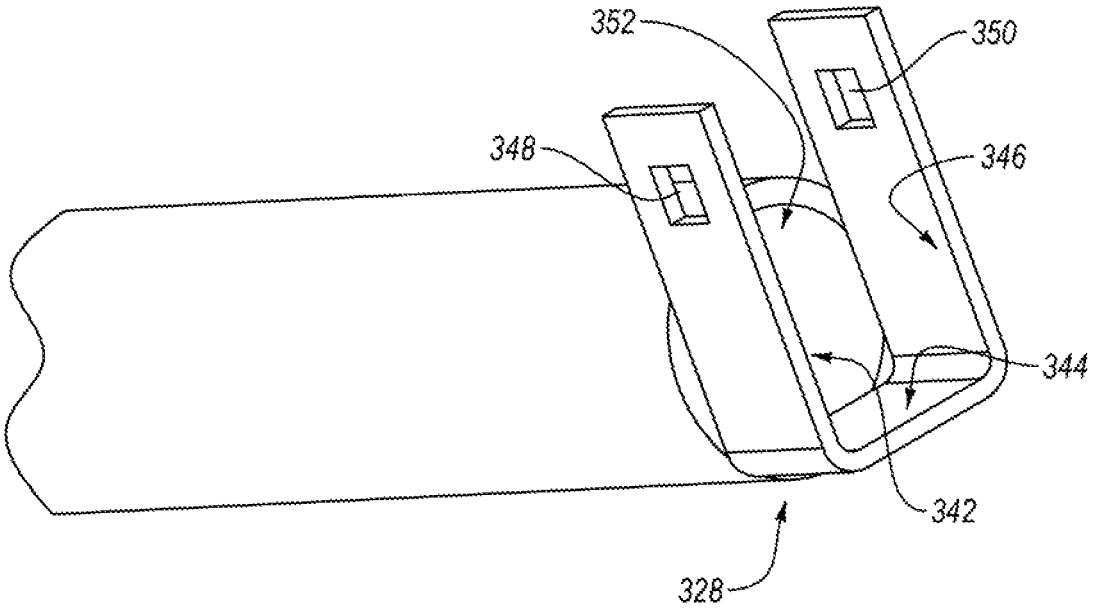
FIG. 3G illustrates an exemplary end view of an adjustable angle brace sleeve of FIG. 3E.

FIG. 3A illustrates an exemplary side view of an adjustable angle brace according to an embodiment of the invention. FIG. 3B illustrates an exemplary side end view of an adjustable angle brace of FIG. 3A. FIG. 3C illustrates an exemplary end view of an adjustable angle brace of FIG. 3A. FIG. 3D illustrates an exemplary end view of an adjustable angle brace of FIG. 3A. FIG. 3E illustrates an exemplary side view of an adjustable angle brace sleeve of FIG. 3A. FIG. 3F illustrates an exemplary end view of an adjustable angle brace sleeve of FIG. 3E. FIG. 3G illustrates an exemplary end view of an adjustable angle brace sleeve of FIG. 3E.

FIGS. 3A-3E, the adjustable brace 300 for a fencing system includes a first unit 302 and a second unit 304. The first unit 302 includes a first end 306, a second end 308, and a middle section 310 extending from the first end 306 to the second end 308. A bracket 307 is attached to the first end 306.

The bracket 307 is attached, e.g., welded, at angle 312 relative to a centerline of the middle segment 310. The bracket 307 includes first section 312, a middle section 314, and a second section 316. The first section 312 and the middle section 314 are arranged at an angle of about ninety degrees between the two sections. The second section 316 and middle section 314 are arranged at an angle of about ninety degrees between the two sections. The second end 308 includes no bracket and has a T-shape or Y-shape. Of course, the second end 308 can have any shape or geometry.

The middle segment 310 includes studs or nubs or protrusions 315 spaced along the length of the middle segment 310. These protrusions 315 are configured to allow the brace to couple between the protrusions 315. In a preferred embodiment, the spacing between the protrusions is uniform throughout the length of the middle section 310. The spacing could be in the range from about 0.10 inches to about 2 inches or greater between the protrusions 315. The height of the protrusions 315 can be from about 0.10 inches to about 2 inches or greater. The bracket 307 includes a first hole 318 and a second hole 320 dimensioned to receive a predetermined geometry of an attachment mechanism, e.g., bolt. The bracket 307 can also have an offset as described herein. The second end 308 is dimensioned to fit within a portion the second unit 304.

The second unit 304 includes a first end 322, a second end 324 and middle section 325 extending from the first end 322 to the second end 328. The first end 322 includes a bracket 326 and the second end 324 includes a bracket 328. The bracket 326 includes first section 330, a middle section 332 and a second section 334. The first section 330 includes a hole 336 and the second section 334 includes a hole 338. The bracket 326 is attached at an angle 340 in a range from about 5 degrees to about 85 degrees. In a preferred embodiment, the angle 227 is about 45 degrees.

The second end 324 includes a bracket 328 including a first section 342, a middle section 344 and a second section 346. The first section 346 includes a hole 348 and the second section 346 includes a hole 350. The bracket 328 is attached along a center line of the middle segment 325 and not an offset and no angle. The bracket 328 is positioned orthogonal to the middle segment 325.

The middle section 325 is a hollow structure dimensioned to allow the first end 308 and a portion of the middle segment to be received within the hollow structure. The hollow structure includes a lumen 352 extending from the first end to a second end of the middle segment 325. The lumen can have any cross-sectional geometry, e.g., circle, triangle, square, pentagon, hexagon, heptagon, octagon, and combinations of the same. In a preferred embodiment, the cross-sectional geometry is a circle.

The first unit 302 can include a T-post or Y-post made of metal, e.g., steel, alloy, thermoplastic, rail steel and combinations of the same. When using the conventional T-Post or Y-post, the end portions are removed to make ends a ninety-degree angle configured to receive a brace. The first unit 302 includes studs or nubs or protrusions 315 spaced along the length of the brace. These protrusions 315 are configured to allow the brace to couple between the protrusions 315. In a preferred embodiment, the spacing between the protrusions 315 is uniform throughout the length of the middle section 310 of the first unit 302. The spacing could be in the range from about 0.10 inches to about 2 inches or greater between the protrusions 315. The first unit 302 and second unit 304 can be made of a material including one or more of metal, steel, iron, thermoplastic, alloy and combinations of the same. The first unit 302 and the second unit 304 are made from material including one or more of metal, steel, iron, thermoplastic, alloy and combinations of the same. Optionally and/or alternatively, any of the brackets 307, 326 and 328 can include an offset as described herein.

Figure 4A:
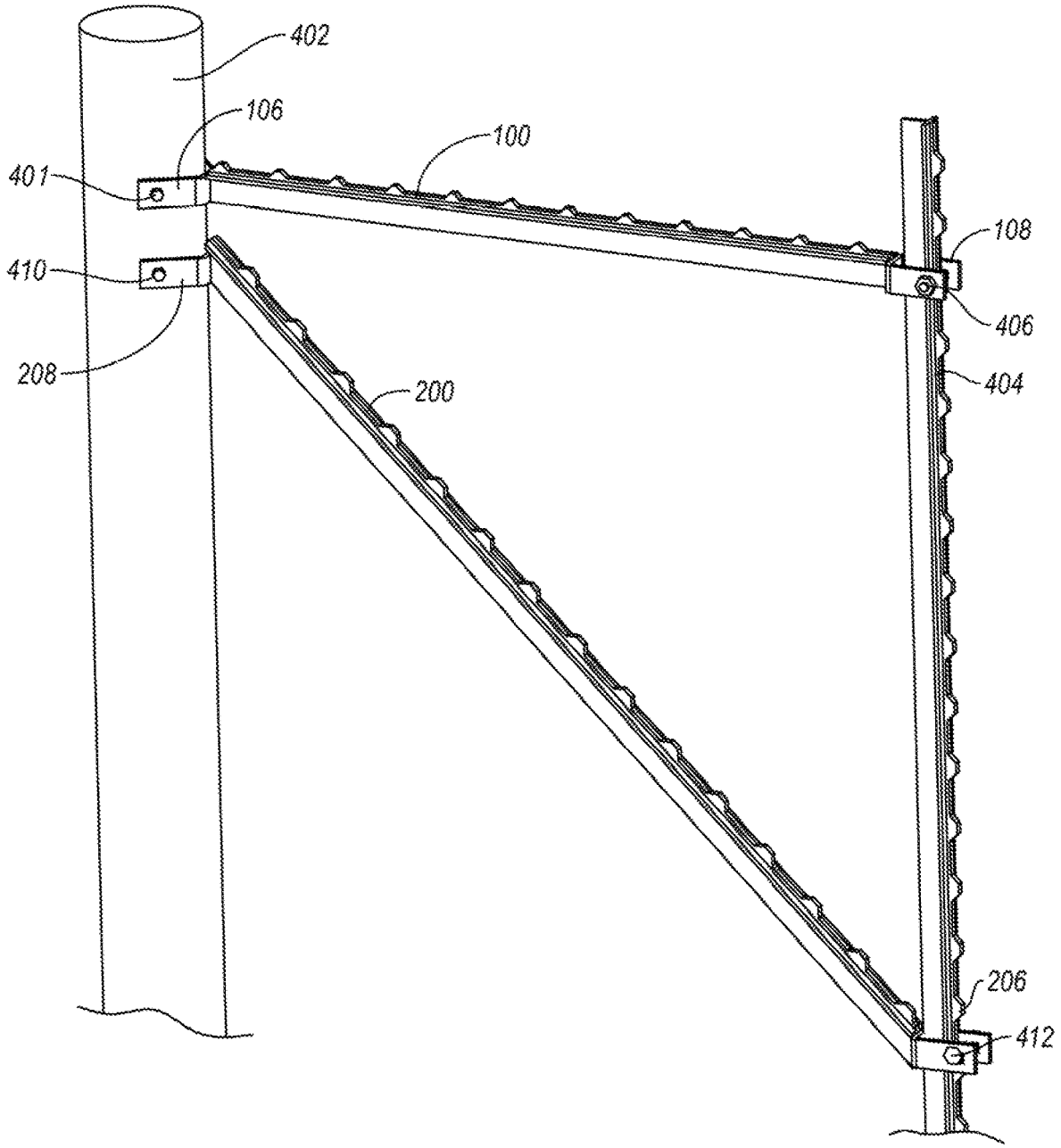
FIG. 4A illustrates an exemplary view of installed fencing system according to another embodiment of the invention.
Figure 4B:
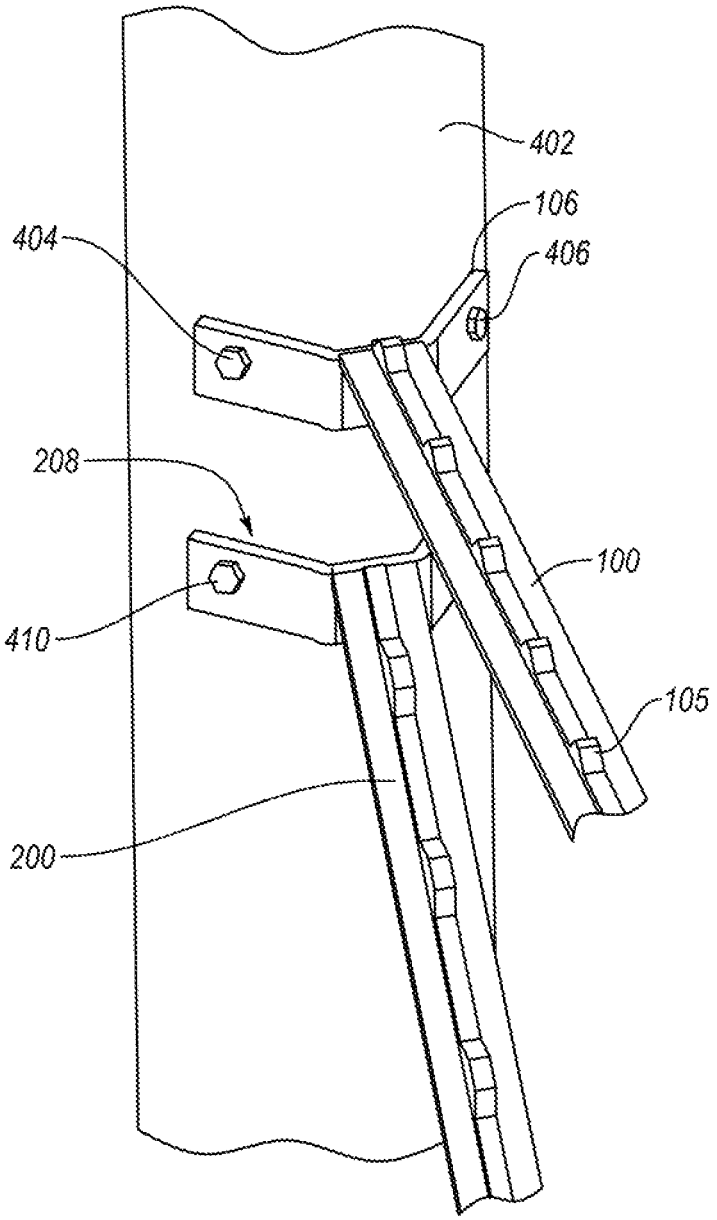
FIG. 4B illustrates an exemplary close-up view of the assembled fencing system of FIG. 4A.

FIG. 4A illustrates an exemplary view of installed fencing system according to another embodiment of the invention. FIG. 4B illustrates an exemplary close-up view of the assembled fencing system of FIG. 4A.

Referring to FIGS. 4A-4B, in one embodiment components described herein, can be used as part of system 400 with existing structures to allow for rapid deployment. The system 400 includes an existing corner post 402, e.g., wood post and a conventional second post 404, e.g., metal T-post or Y-post. Of course the corner post 402 can also be a conventional metal T-post or Y-post. The non-adjustable brace 100 having a first end 102 and a bracket 106 is attached to the fence post 402 and the second end 104 having a bracket 106 is attached to the fence post 404. The bracket 106 of horizontal brace 100 is widened to substantially fit the geometry of the post 402, and a first bolt 401 is positioned through holes 116 of bracket 104 and a second bolt (not shown) is positioned through hole 118 of bracket 106. A third bolt 406 is positioned through the holes 117, 118 of bracket 108. The first bolt 401 and second bolt are configured to attach to wood in this embodiment. The performations 122 assist with the ease of widening, i.e., less pressure is required to widen as compared to a bracket without performations. The bracket 108 of horizontal brace 100 is narrowed to substantially fit the geometry of the post 404, and a second bolt 406 is positioned through the first hole 224 and second hole 226.

The bolt 406 is attached to a nut to allow the bracket 108 to tighten and be a locked position between two protrusions. Optionally and/or alternatively, when no protrusions are utilized and the bracket 108 attaches to the post with a compressive force of the bolt 406 and nut (not shown).

The non-adjustable angle brace 200 having a first end 202 and a bracket 208 is attached to the fence post 402 and the second end 204 having a bracket 206 is attached to the fence post 404. The bracket 208 of the non-adjustable angle brace 200 is widened to substantially fit the geometry of the post 402, and a bolt 410 and another bolt (not shown) is positioned through holes 116, 118 of bracket 208 to attach the bracket to the fence post 402. A bolt 412 is positioned through the holes 117, 118 of bracket 206. The bolt 410 is configured to attached to wood in this embodiment. The performations 122 assist with the ease of widening, i.e., less pressure is required to widen as compared to a bracket without performations. The bracket 206 of brace 200 is narrowed to substantially fit the geometry of the post 404, and a bolt 412 is positioned through the first hole 218 and second hole 216. The final assembly is a corner assembly.

Figure 5A:
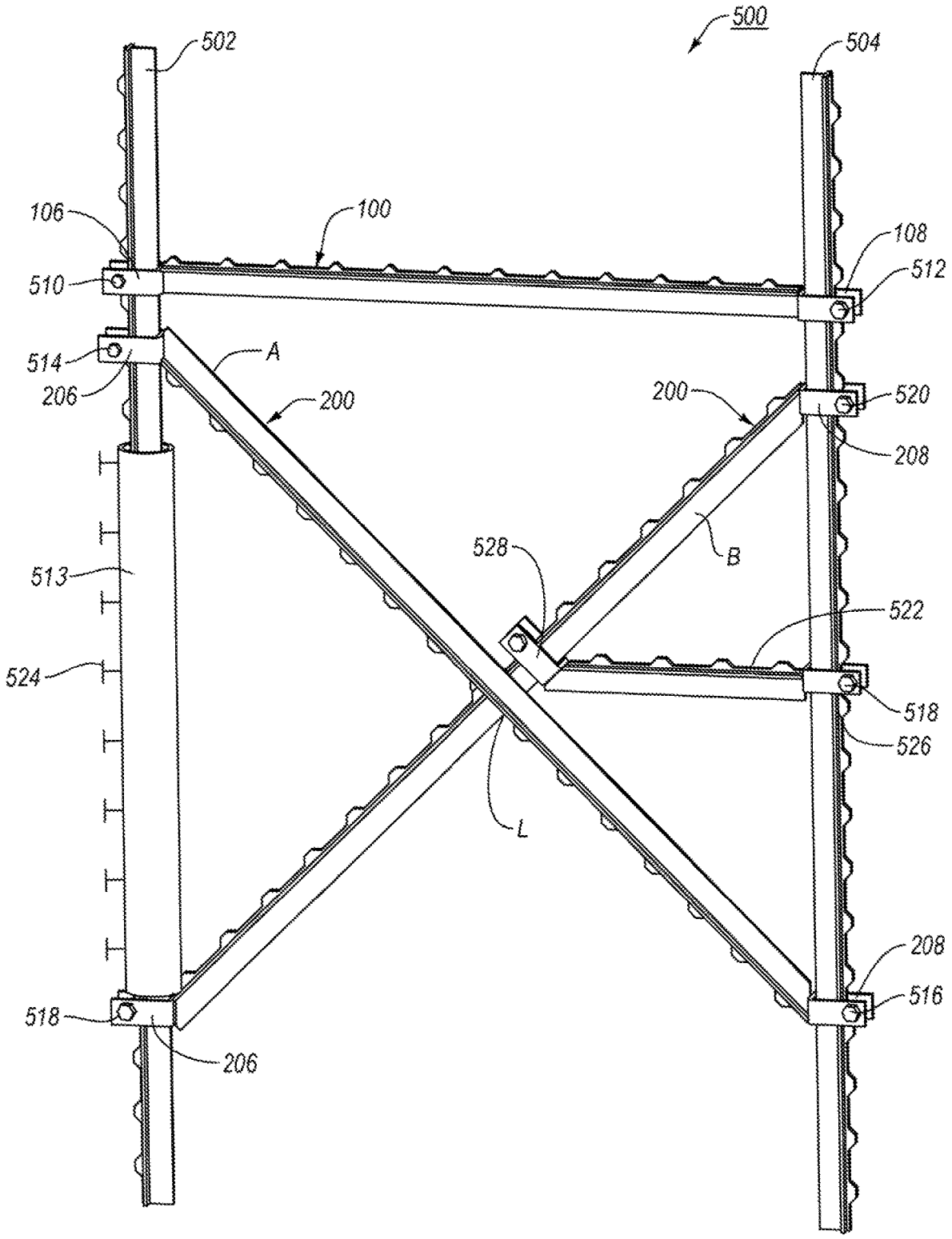
FIG. 5A illustrates an exemplary view of assembled fencing system according to another embodiment of the invention.
Figure 5B:
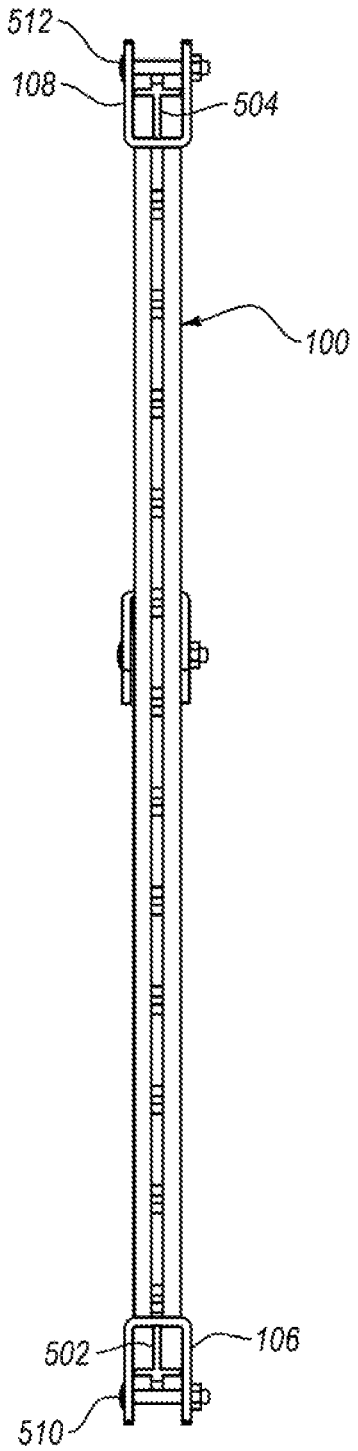
FIG. 5B illustrates an exemplary top view of the assembled fencing system of FIG. 5A.

FIG. 5A illustrates an exemplary view of assembled fencing system according to another embodiment of the invention. FIG. 5B illustrates an exemplary top view of the assembled fencing system of FIG. 5A.

Referring to FIGS. 5A-5B, in one embodiment components described herein, can be used as part of system 500 with existing structures to allow for rapid deployment as a mid-span assembly, which are required when distances are in a range from about 700 ft to about 1500 feet or greater between the corner posts and assembly. The system 500 includes a first corner post 502, e.g., a metal T-post or Y-post, and a second post 504, e.g., metal T-post or Y-post. In this embodiment, the non-adjustable brace 100 does not include an offset, but may include an offset as discussed herein. The non-adjustable brace 100 having a bracket 106 is attached to the fence post 502. The bracket 106 of horizontal brace 100 is narrowed to fit or substantially fit the geometry of the post 502 and a bolt 510 is positioned through the first hole 116 and second hole 118 of the bracket 106 and secured to a nut. The bolt 510 is attached to a nut to allow the bracket 106 to tighten and be a locked position between two protrusions when present or to fit the geometry of the post 502. Optionally and/or alternatively no protrusions are utilized and the bracket attaches to the post with a compressive force of the bolt and nut.

Bracket 108 is attached to the fence post 504. The bracket 108 of horizontal brace 100 is narrowed to fit or substantially fit the geometry of the post 504 and a bolt 512 is positioned through the first hole 117 and a second hole 118 of the bracket 108 and secured to a nut. The bolt 512 is attached to a nut to allow the bracket 108 to tighten and be a locked position between two protrusions when present or to fit the geometry of the post 504. Optionally and/or alternatively no protrusions are utilized and the bracket attaches to the post with a compressive force of the bolt and nut.

The non-adjustable angle brace 200 is at a first position A and the non-adjustable brace 200 at a second position B. Each non-adjustable angle brace 200 having a first bracket 204 and second bracket 206.

The non-adjustable angle brace 200 at a first position A has a bracket 206 narrowed to fit or substantially fit the geometry of the post 502 and a bolt 514 positioned through the first hole 216 and second hole 218 of the bracket 206 and secured to a nut. The bolt 514 is attached to a nut to allow the bracket 206 to tighten and be a locked position between two protrusions when present or to fit the geometry of the post 502. Optionally and/or alternatively no protrusions are utilized and the bracket attaches to the post with a compressive force of the bolt and nut.

The non-adjustable angle brace 200 at a first position A has a bracket 208 narrowed to fit or substantially fit the geometry of the post 504 and a bolt 516 positioned through the first hole 224 and second hole 226 of the bracket 206 and secured to a nut. The bolt 516 is attached to a nut to allow the bracket 204 to tighten and be a locked position between two protrusions when present or to fit the geometry of the post 504. Optionally and/or alternatively no protrusions are utilized and the bracket attaches to the post with a compressive force of the bolt and nut.

The offset 211 of bracket 206 and the offset 215 of bracket 204 are positioned on the same side to the same percentage offset. In a preferred embodiment, the offset 211 and 215 is about 0.25 inches or greater.

The non-adjustable angle brace 200 at a second position B has a bracket 206 narrowed to fit or substantially fit the geometry of the post 502 and a bolt 518 is positioned through the first hole 216 and second hole 218 of the bracket 206 and secured to a nut. The bolt 518 is attached to a nut to allow the bracket 206 to tighten and be a locked position between two protrusions when present or to fit the geometry of the post 502. Optionally and/or alternatively, when no protrusions are utilized the bracket attaches to the post with only compressive force of the bolt and nut.

Bracket 206 of the non-adjustable angle brace 200 at a second position B has a bracket 206 narrowed to fit or substantially fit the geometry of the post 504 and a bolt 520 positioned through the first hole 224 and a second hole 226 of the bracket 206 and secured to a nut. The bolt 520 is attached to a nut to allow the bracket 204 to tighten and be a locked position between two protrusions when present or to fit the geometry of the post 504. Optionally and/or alternatively, no protrusions are utilized the bracket attaches to the post with only a compressive force of the bolt 520 and nut.

The offset 211 of bracket 206 and the offset 215 of bracket 204 are positioned on the same side to the same percentage offset. In addition, the offset of the brackets in brace 200 in position A are each on an opposite side from the offset of brackets of brace 200 shown in position B. This allows the braces to be closer together at a mid-point C. In a preferred embodiment, the offsets 211 and 215 is about 0.5 inches. Referring to FIG. 5B, because the offset of braces in position A and position B are on different sides it allows the braces to be arranged closer together and pass at mid-point C.

Optionally and/or alternatively, a tensioning unit 520 and tensioning unit 522 can be utilized. These tensioning units allo the fence posts 502 and 504 to be strengthened. When tensioning as described in FIG. 8 the fence posts may bend or bow. The tensioning unit 513 includes optional tie downs 524 to allow a user to connect a fencing wire with a clip or tie. The tensioning unit 513 is a hollow sleeve of any geometry configured to slide over the fence post and provide strength. The length of the unit can be adjusted to any length less than the length of the fence post. In another embodiment, the tensioning unit 522 includes first bracket 526 and a second bracket 528. The brackets 526, 528 include holes as described herein and is attached with bolts as described herein.

Figure 6:
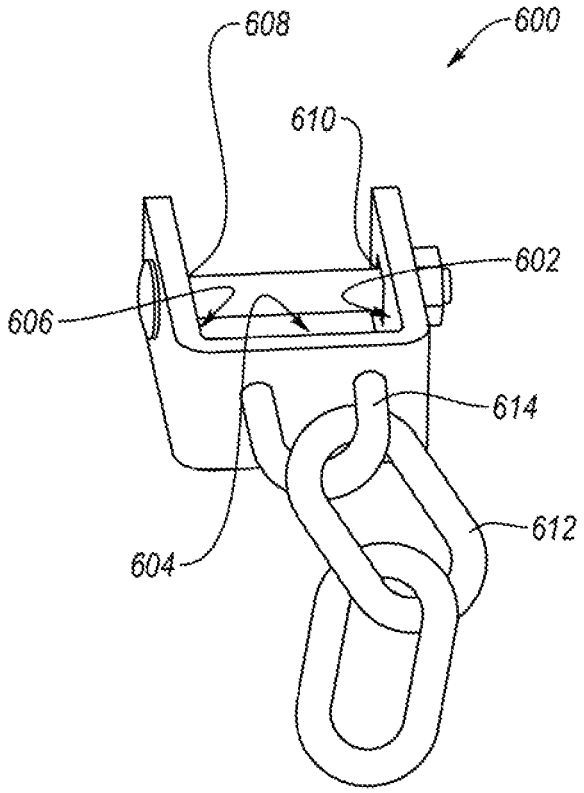
FIG. 6 illustrates an exemplary side view of a bracket according to an embodiment of the invention.

FIG. 6 illustrates an exemplary side view of a bracket according to an embodiment of the invention.

Referring to FIG. 6, the apparatus 600 is configured to be utilized when constructing the fence. The apparatus includes a bracket shown in FIG. 1E having a first section 602, middle section 604 and third section 606. The first section 602 and middle section 604 are arranged at an angle of about ninety degrees between the two sections. The third section 606 and middle section 604 are arranged at an angle of about ninety degrees between the two sections. A first hole 608 and second hole 610 are also included in the bracket. A coupling unit 614 is positioned on the apparatus 600 and one or more extension units 612 are coupled to the coupling unit. Optionally and/or alternatively, the bracket has a V-shape by eliminating the middle section 604, thereby the first section 602 and third section 606 connect at an angle in a range from about 15 degrees to about 75 degrees or greater. In a preferred embodiment, the angle is in a range from about 50 degrees to about 75 degrees. In a most preferred embodiment, the angle is about 67 degrees.

Figure 7:
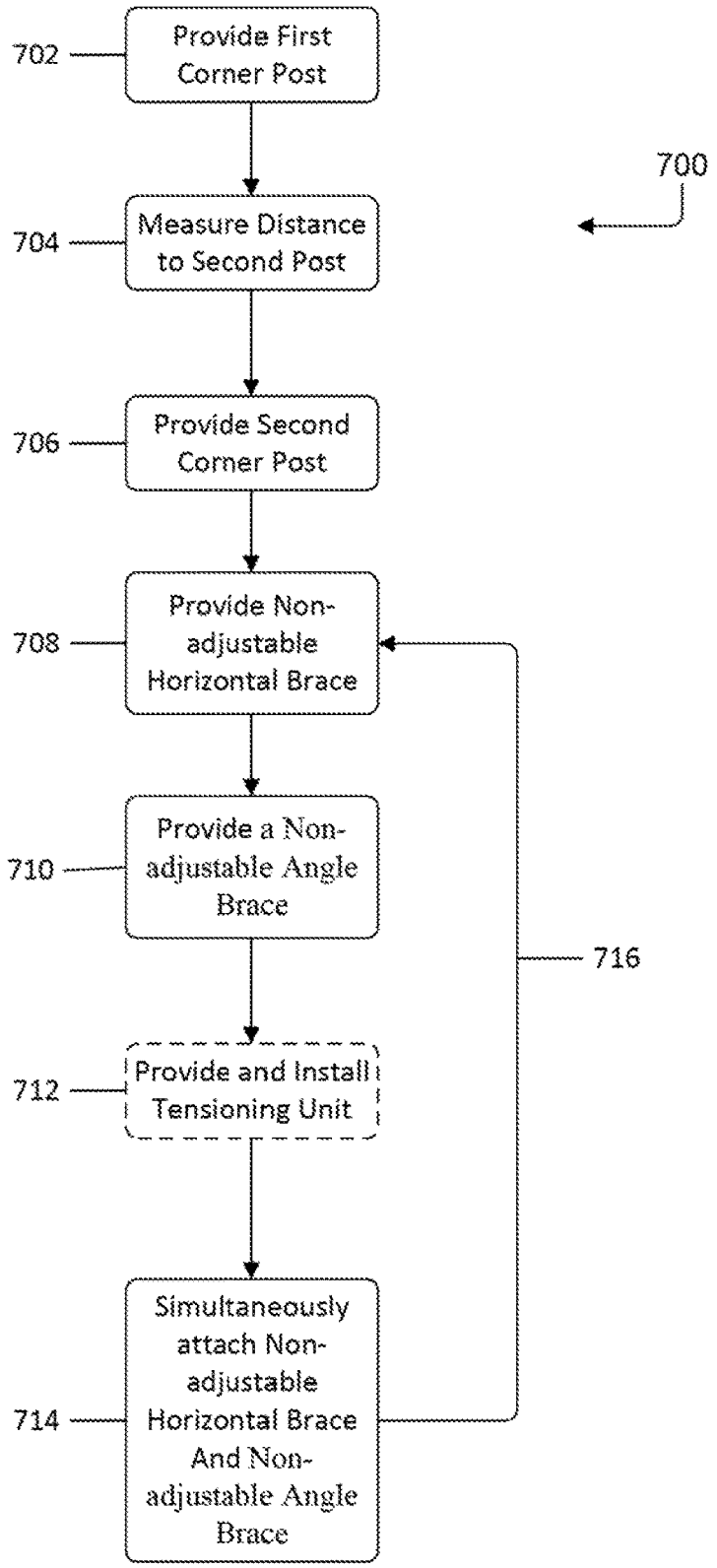
FIG. 7 illustrates a method of installing a fencing system on non-sloped ground.

FIG. 7 illustrates a method of installing a fencing system on non-sloped ground.

Referring to FIG. 7, the method 700 includes determining where a fence belongs between two or more predetermined points. This can be done with a surveyor or other method as known in the art. Locate a first corner post location and locate a second corner post location. When the topography between the first corner post location and the second corner post location is substantially flat one can use the non-adjustable angle braces 100 and 200, as described herein in view of method 700. When the topography between the first corner post location and the second corner post location is substantially not flat, e.g., pm a hill or angled, one can use the adjustable angle braces 300 as described herein in view of method 900.

In method 700 the method includes step 702 of providing a corner post at a first predetermined location. The corner post may be any conventional corner post, e.g., wood, T-Post, Y-Post and the like. In a preferred embodiment, a T-Post is set about 2 feet into the ground at the first location. Next, in step 704, a horizontal brace 100 is extended from the first corner post to where the second post should be posited, e.g., to provide an accurate measurement. A second corner post is provided in step 706. A horizontal brace 100 is provided in step 708 and a non-adjustable angle brace 200 is provided in step 710. Optionally, in step 712 a tensioning unit 508 or 506 can be utilized. In step 714 the horizontal brace 100 and non-adjustable angle brace 200 are installed simultaneously. In one embodiment, as shown in either FIG. 4A or 5A, the bracket 108 and 204 are arranged and attached to the first corner post simultaneously with attachment mechanisms, e.g., bolts and nuts. Next the bracket 106 and 206 are attached to the second corner post simultaneously with attachment mechanisms, e.g., bolts and nuts. In step 716, the process is repeated with a corner post at the second predetermined location, which is at a different geographic location.

Now, a first corner post assembly, as shown in FIG. 4A or 5A, is positioned at a first geographic location and a second corner post assembly is posited at a second geographic location. As described herein the assembly of 5A only includes one angle brace, e.g., position A or B.

Figure 8:
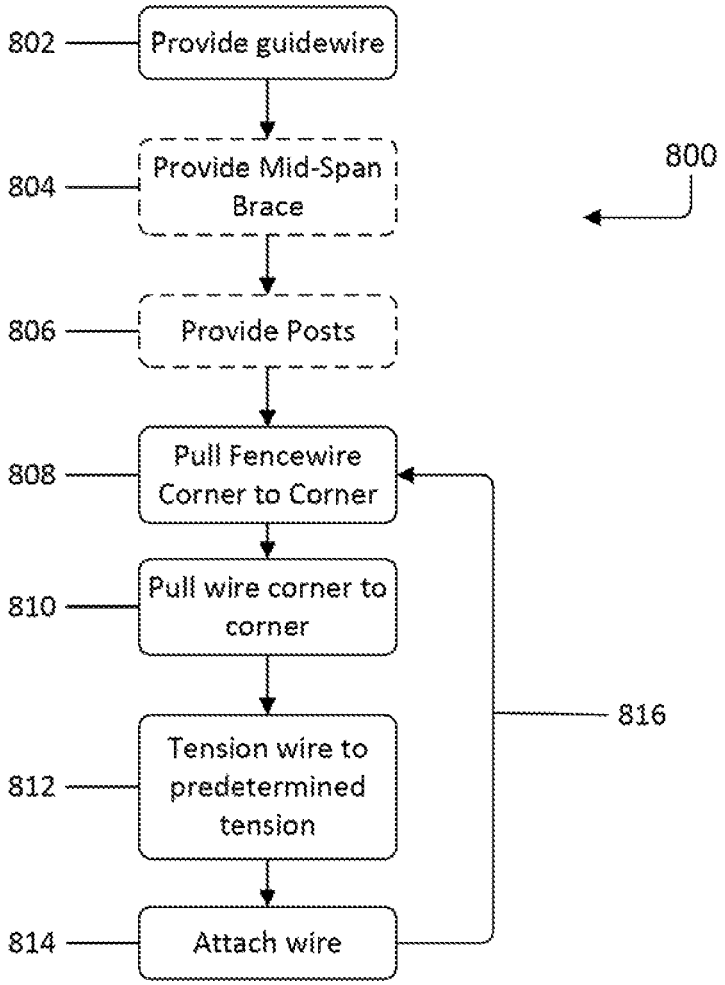
FIG. 8 illustrates a method of tensioning a fencing wire.

FIG. 8 illustrates a method 800 of tensioning a fencing wire. Referring to FIG. 8, after the two corner post assemblies are installed a guidewire is positioned between the two corner post assemblies in step 802. If the distance is 200 yards or more a mid-span brace as shown in FIG. 5A should be utilized (step 804). Also, optionally, vertical posts, T-posts or Y-posts, are positioned at predetermined intervals, e.g., in a range from about 6 ft or greater between each post. Other conventional posts may be utilized, e.g., plastic, metal, wood, composite, and combinations of the same. Next, in step 808 the fence wire is attached to each corner post assembly in a first position or between the mid-span and corner post assembly when used. The first position is top most position and pulled corner to corner in step. A tensioner as known in the art is used in step 812 to achieve a predetermined tension on the fence wire. The predetermined tension may be about 40 lbs/ft$^2$ to about 80 lbs/ft$^2$ or greater. The wire is now attached at the predetermined location via a wire attachment clip in step 814. Optionally, prior to tensioning the wire a clip as shown in FIG. 6 may be utilized. This process is repeated for the number via step 816 to achieve a predetermined number of wires, e.g., 2-5 wires or more, at different locations. Typically, the wires are spaced a substantially equal distance between each wire. The fence wires may include straight wire, braided wire, barb wire, razor wire, and any other conventional fence wire.

Figure 9:
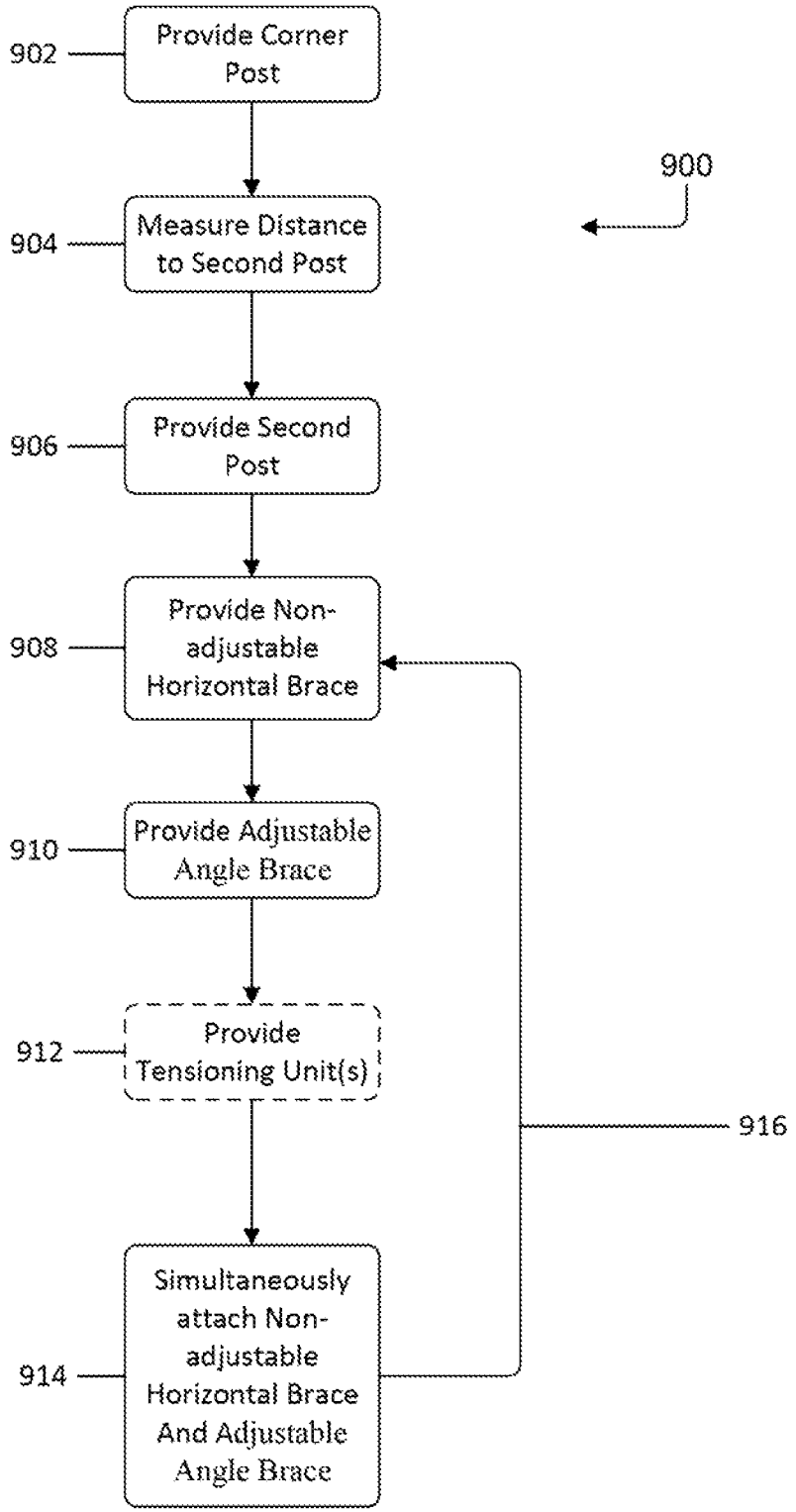
FIG. 9 illustrates a method of installing a fencing system on sloped ground.

FIG. 9 illustrates a method of installing a fencing system on sloped ground.

Referring to FIG. 9, the method 900 includes determining where fence belongs between two or more predetermined points. When the topography between the first corner post location and the second corner post location is substantially not flat, e.g., on a hill, angled, or a slope, one can use the adjustable angle braces 300 as described herein in view of method 900.

In method 900 the method includes step 902 of providing a corner post at a first predetermined location. The corner post may be any conventional corner post, e.g., wood, T-Post, Y-Post and the like. In a preferred embodiment, a T-Post is set about 2 feet into the ground at the first location. Next, in step 904, a horizontal brace 100 is extended from the first corner post to where the second post should be posited, e.g., to provide an accurate measurement to the second post. A second corner post is provided in step 906. A horizontal brace 100 is provided in step 908 and an adjustable angle brace 300 is provided in step 910. Optionally, in step 912 a tensioning unit 508 or 506 can be utilized. In step 914 the horizontal brace 100 and an adjustable angle brace 300 are installed simultaneously.

In this embodiment, the adjustable angle brace is adjusted to the desired distance by moving the first unit to a desired location within a lumen 352 of the second unit 304. After the desired length is established a bolt is placed through holes in bracket 328 and tightened with a nut to prevent further movement. In a preferred embodiment, the second unit 302 includes protrusions and the bolt resides between two protrusions. The bolt is attached to a nut to allow the bracket 329 to tighten and be a locked position between two protrusions. Optionally and/or alternatively, no protrusions are utilized and the bracket attaches to the post with a compressive force of the bolt and nut.

In step 914, the bracket 326 and 108 are attached to the first corner post simultaneously with attachment mechanisms, e.g., bolts and nuts. In addition, the bracket 306 and bracket 106 are attached to the second corner post. This step on the second corner may or may not be done simultaneously. In step 916, the process is repeated with a corner post at the second predetermined location, which is at different geographic location. Next the fencing wire can be applied as described herein with reference to FIG. 8.

The present disclosure, in various aspects, embodiments, and/or configurations, includes components, methods, processes, systems and/or apparatus substantially as depicted and described herein, including various aspects, embodiments, configurations of embodiments, sub-combinations, and/or subsets thereof. Those of skill in the art will understand how to make and use the disclosed aspects, embodiments, and/or configurations after understanding the present disclosure. The present disclosure, in various aspects, embodiments, and/or configurations, includes providing devices and processes in the absence of items not depicted and/or described herein or in various aspects, embodiments, and/or configurations hereof, including in the absence of such items as may have been used in previous devices or processes, e.g., for improving performance, achieving ease and/or reducing cost of implementation.

The foregoing discussion has been presented for purposes of illustration and description. The foregoing is not intended to limit the disclosure to the form or forms disclosed herein. In the foregoing description for example, various features of the disclosure are grouped together in one or more aspects, embodiments, and/or configurations for the purpose of streamlining the disclosure. The features of the aspects, embodiments, and/or configurations of the disclosure may be combined in alternate aspects, embodiments, and/or configurations other than those discussed above. This method of disclosure is not to be interpreted as reflecting an intention that the claims require more features than are expressly recited in each claim. Rather, as the following claims reflect, inventive aspects lie in less than all features of a single foregoing disclosed aspect, embodiment, and/or configuration. Thus, the following claims are hereby incorporated into this description, with each claim standing on its own as a separate preferred embodiment of the disclosure.

Moreover, though the description has included a description of one or more aspects, embodiments, and/or configurations and certain variations and modifications, other variations, combinations, and modifications are within the scope of the disclosure, e.g., as may be within the skill and knowledge of those in the art, after understanding the present disclosure. It is intended to obtain rights which include alternative aspects, embodiments, and/or configurations to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A fence post bracing apparatus, comprising:

a first elongated member having a first end having a first bracket, a second end having a second bracket and lumen extending from the first end to the second end, wherein the first bracket is arranged at a first angle relative to a center-line of the first elongated member and the second bracket is arranged at a second angle relative to a center-line of the first elongated member, wherein the first angle is different than the second angle; and a second elongated member having a first end having a third bracket and the second end having no bracket, wherein the second end of the second elongated member is configured to fit within a portion of the lumen of the first elongated member, wherein the third bracket is arranged at a third angle relative to a center-line of the second elongated member.

2. The apparatus of claim 1, wherein the first angle is in a range from about 30 degrees to about 55 degrees.

3. The apparatus of claim 1, wherein the second angle is about 90 degrees.

4. The apparatus of claim 1, wherein the second elongated member comprises one or more protrusions.

5. The apparatus of claim 1, wherein each of the first bracket, second bracket, and third bracket comprises a first section, a second section and a third section, the first section and the second section are arranged at an angle of about 90 degrees and the third section and the second section are arranged angle of about 90 degrees to each other, wherein the first section has a hole with or without threads configured to receive a portion of a bolt and the third section has a hole with or without threads configured to receive the portion of the bolt.

6. The apparatus of claim 5, wherein each of the first bracket, second bracket, and third bracket comprise one or more of one or more perforations, less material, and a creased material, between the first section the second section and the second section and the third section to allow the angle to be adjusted in a range from about 180 degrees to about 0 degrees.

7. The apparatus of claim 6, the angle to be adjusted is in a range from about 30 degrees to about 130 degrees.

8. The apparatus of claim 5, wherein one or more of the first bracket, second bracket, and third bracket are attached at an offset.

9. A fence post bracing apparatus, comprising:

a first elongated member having a first end having a first bracket, a second end having a second bracket and lumen extending from the first end to the second end, wherein the first bracket is arranged at a first angle relative to a center-line of the first elongated member and the second bracket is arranged at a second angle relative to a center-line of the first elongated member, wherein the first angle is different than the second angle;

a second elongated member having a first end having a third bracket and the second end having no bracket, wherein the second end of the second elongated member is configured to fit within a portion of the lumen of the first elongated member, wherein the third bracket is arranged at a third angle relative to a center-line of the second elongated member;

an elongated member having a first end having a first bracket comprising a first bracket arm extending from the first end, a second bracket arm spaced apart from the first bracket arm to create a first free space and a middle section connected to the first end, the first bracket arm and the second bracket arm, and a second end having a second bracket comprising a first bracket arm extending from the second end, a second bracket arm spaced apart from the first bracket arm of the second end to create a second free space and a middle section connected to the second end of the second bracket arm, the first bracket arm and the second bracket arm, wherein the first bracket is arranged at a first angle relative to a center-line of the elongated member and the first angle is in a range from about 5 degrees to about 60 degrees, wherein the second bracket is arranged at a second angle relative to a center-line of the elongated member and the second angle is in a range from about 5 degrees to about 60 degrees, wherein the middle section of the first bracket is attached to the first end at a first offset such that a center portion of the middle section of the first bracket is not on the center-line of the elongated member, and wherein the middle section of the second bracket is attached to the second end at a second offset such that a center portion of the middle section of the second bracket is not on the center-line of the elongated member.

10. The apparatus of claim 9, wherein the first angle and second angle is in a range from about 10 degrees to about 25 degrees.

11. The fence post bracing member of claim 9, wherein one or more of the first offset and the second offset is in a range from about 0.25 inches to about 0.5 inches from the center-line of the elongated member.

12. The fence post bracing member of claim 9, wherein the first offset is in a range from about 0.25 inches to about 0.5 inches from the center-line of the elongated member and the second offset is in a range about 0.25 inches to about 0.5 inches from the center-line of the elongated member.

13. The fence post bracing member of claim 12, wherein the first offset and second offset are identical.

14. The fence post bracing member of claim 9, wherein the elongated member further comprises one or more protrusions.

15. The fence post bracing member of claim 9, wherein the elongated member comprises steel.

16. A method of installing a fence apparatus, comprising:

providing a first corner fence post;

anchoring the first corner fence post in a first ground region;

measuring a distance from the first corner fence post with a non-adjustable horizontal brace, wherein the non-adjustable horizontal brace comprises an elongated member having a first end having a first bracket and a second end having a second bracket, wherein the first bracket is arranged at a first angle relative to a centerline of the elongated member, wherein the second bracket is arranged at a second angle relative to a centerline of the elongated member, wherein the first bracket is attached to the first end at a first offset, and wherein the second bracket is attached to the second end at a second offset;

providing a second corner fence post;

anchoring the second corner fence post in a second ground region spaced apart from the first ground region at the measured distance;

providing an adjustable angle brace comprising an elongated tubular member having a first end having a first bracket, a second end having a second bracket and lumen extending from the first end to the second end, wherein the first bracket is arranged at a first angle relative to a centerline of the elongated tubular member and the second bracket is arranged at a second angle relative to a centerline of the elongated tubular member, wherein the first angle is different compared to the second angle and an elongated member arranged within a portion of the elongated tubular member such that a predetermined distance protrudes from the elongated tubular member, the elongated member having a first end having a third bracket and the second end having no bracket, wherein the third bracket is arranged at a third angle relative to a centerline of the elongated member, wherein the first angle and the third angle are substantially identical to each other;

attaching the non-adjustable horizontal brace and the adjustable angle brace to the first corner fence post; and attaching the non-adjustable horizontal brace and the adjustable angle brace to the second corner fence post.

17. The method of claim 16, further comprising the step of installing one or more fence wires.

18. The method of claim 16, wherein one of more of the first ground region or the second ground region is not level.

19. The method of claim 16, wherein the first angle is in a range from about 30 degrees to about 55 degrees.

20. The method of claim 16, wherein the first offset and second offset are substantially identical to each other.

* * * * *